United States Patent [19]

Pinkow

[11] 4,217,950

[45] Aug. 19, 1980

[54] CONTINUOUS CASTING APPARATUS

[75] Inventor: Günter K. Pinkow, Düsseldorf, Fed. Rep. of Germany

[73] Assignee: Sack GmbH, Düsseldorf, Fed. Rep. of Germany

[21] Appl. No.: 1,847

[22] Filed: Dec. 11, 1978

[51] Int. Cl.[3] ..... B22D 11/08

[52] U.S. Cl. ..... 164/426; 164/446

[58] Field of Search ..... 164/426, 446

[56] References Cited

U.S. PATENT DOCUMENTS

| | | | |
|---|---|---|---|
| 3,324,934 | 6/1967 | Hess et al. | 164/426 |
| 3,628,595 | 12/1971 | Mitchell | 164/426 X |
| 3,814,169 | 6/1974 | Knell et al. | 164/426 |

FOREIGN PATENT DOCUMENTS 1158752 7/1969 United Kingdom .

*Primary Examiner*—Robert D. Baldwin
*Assistant Examiner*—J. Reed Batten, Jr.
*Attorney, Agent, or Firm*—John J. Dennemeyer

[57] ABSTRACT

Continuous casting apparatus includes opposing sets of rollers defining a guide path for a cast section emanating from a mould outlet. A key-piece is keyed to the leading end of the cast section at the mould outlet in a conventional manner. A detachment member is mounted at the end of the guide path for entrainment by the key-piece. The entrained detachment member is constrained to move in a path which has a component directed transversely of the feed direction of the cast section. In this way a releasing force is applied to the key-piece by the feed movement of the cast section.

11 Claims, 4 Drawing Figures

CONTINUOUS CASTING APPARATUS

This invention relates to continuous casting apparatus.

According to the present invention there is provided continuous casting apparatus comprising opposing sets of rollers defining a guide path for a cast section emanating from a mould outlet, a key-piece for the leading end of the cast section and movable along the guide path in a direction away from the mould outlet, and a key-piece detaching station at the end of said guide path including a detachment member mounted for entrainment by said key-piece with a component of movement directed transversely of the cast section feed direction for detaching the key-piece from the cast section.

Preferably, an open-link chain conveyor is attached to the key-piece and the key-piece has end portions extending laterally beyond said chain conveyor. In this case, the detachment member preferably has abutment surfaces arranged in the paths of travel of said end portions for entrainment thereby.

It will be appreciated that in the apparatus according to the invention the force required for detaching the key-piece is provided by the feed movement of the cast section. Accordingly, no drive is necessary for driving the detachment member during the detaching operation. Nevertheless, a drive may be provided for assisting the forward movement of the key-piece after detachment and for restoring the detachment to its starting position. Preferably, therefore, the apparatus additionally comprises a double-acting, fluid pressure operated piston and cylinder drive for the detachment member, said drive including a control valve having a neutral position in which the piston is unloaded by fluid pressure and is movable in the cylinder by the entrainment force. The power drive is preferably started up at exactly the same time as the passage of the key-piece.

The apparatus according to the invention may provide for the detached key-piece to be accelerated in the feed direction of the cast section so as not to obstruct the delivery of the cast section. Alternatively, the detachment member may hold the detached key-piece above the delivery bed so as to allow the cast section to pass therebelow.

Advantageously, the piston of the drive has a relatively large surface arranged to be pressurised for moving the detachment member back into its starting position and a relatively small surface arranged to be pressurised for completing movement of the detachment member in the opposite direction. By this means constant volume fluid delivery to both sides of the piston will cause relatively faster movement of the detachment member and key-piece in the feed direction than in the return direction. In this way, the detached key-piece can be deposited on the delivery bed well in advance of the leading end of the cast section. Alternatively, the same result could be achieved by accelerating the rollers of the delivery bed.

The invention will now be further described by way of example only with reference to the accompanying drawings, in which.

Figure 1:
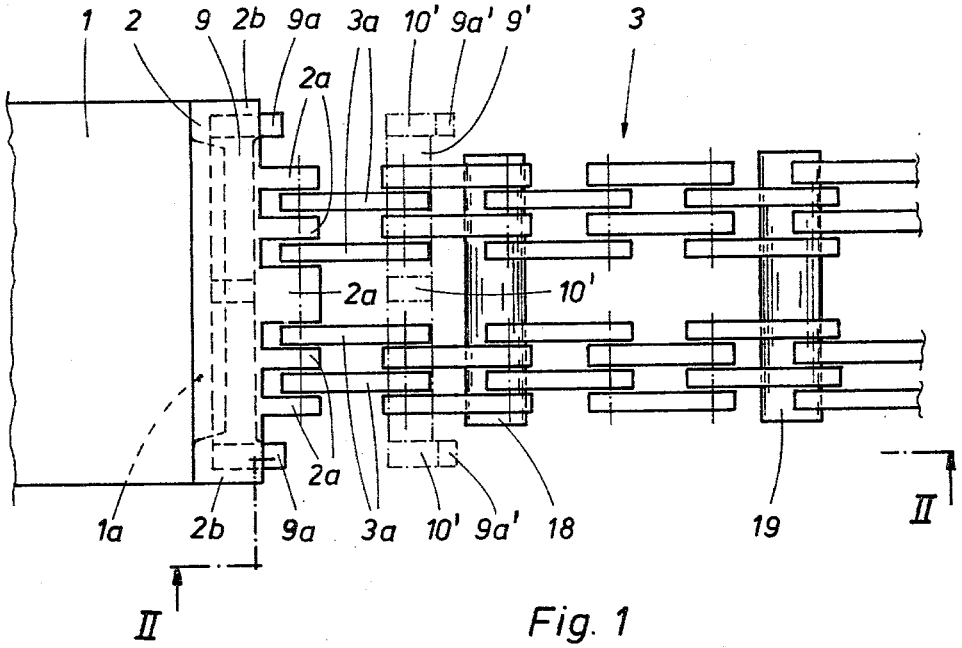
FIG. 1 is a simplified plan view of one embodiment of continuous casting apparatus according to the invention.
Figure 2:
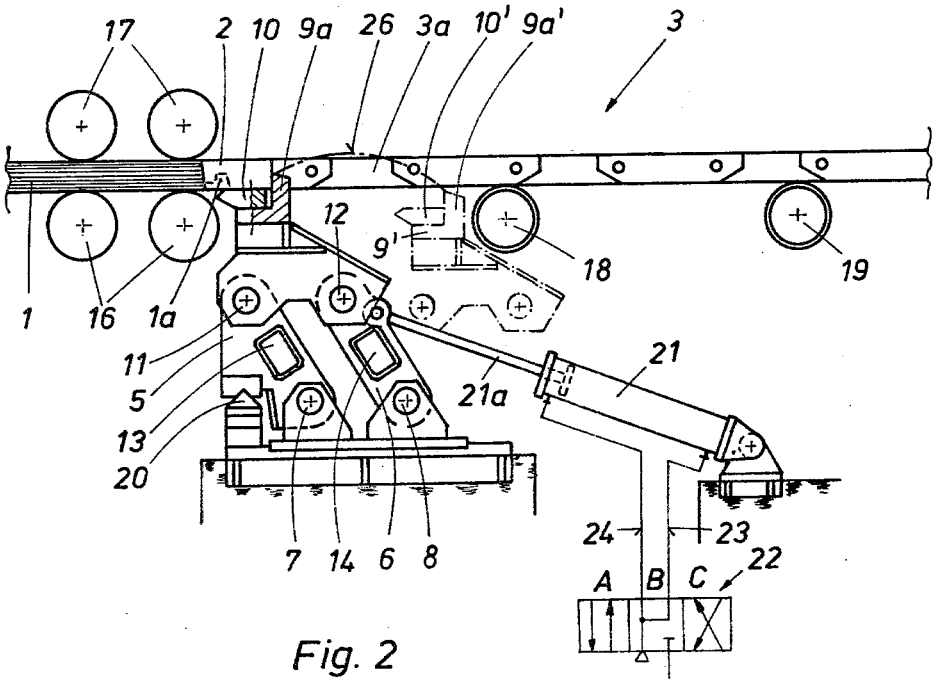
FIG. 2 is a side view, partly in section, on line II—II of FIG. 1.

FIG. 1 shows the leading end of a hot cast metal section 1 of a continuous casting apparatus for slabs, which is connected directly by casting to a starting head or key-piece 2 of a cold section. The starting head 2 comprises a cavity 1*a* of limited length with a hook-like profile, open towards the hot section 1 (FIG. 2), into which cavity a portion of the molten steel of which the section 1 is made may flow when the continuous casting installation is started-up, so that after solidification of the molten metal, there is a connection between the starting head 2 and the hot section 1, which connection can withstand tension but can be severed by a detaching force directed upwards as seen in FIG. 2. It will be understood that the surfaces of the starting head 2 involved in the connection produced by casting, are prepared in a known manner in such a way that they do not become welded to the hot section.

The starting head 2 is provided with integral tongues 2*a* to which the first links 3*a* of an open-link chain 3 are connected by a joint pin (not shown). As can be seen, the width of the open-link chain 3, which together with the starting head 2 represents the so-called cold section, is less than the width of the starting head 2, so that the starting head 2 has free ends 2*b*, where it is accessible.

The actual detaching apparatus is illustrated in FIG. 2. It consists of two pairs of guide-rods 5 and 6 of equal length forming a parallelogram, which are pivotally mounted on pivot pins 7 and 8. Each pair of guide-rods 5, 6 is located to one side of the path of travel of the open-link chain 3. The pairs of guide-rods 5, 6 are connected by a coupling 9 by way of pivot pins 11 and 12. In this embodiment, the coupling 9 is a bar connecting both pairs of guide-rods, which is shown in its initial position in FIG. 1 located below the starting head 2, with the outline of the coupling 9 being illustrated in FIG. 1 by combination of full and broken lines. The coupling 9 comprises three raised release surfaces 10, namely two lateral surfaces and a central surface, as is likewise shown in FIG. 1 in conjunction with the position of the coupling 9' illustrated in dot-dash line, with the three release surfaces 10'.

The guide-rods 5 as well as the guide-rods 6 on both sides of the open-link chain 3 are interconnected by way of rigid transverse bars 13, 14, so that the detaching apparatus consisting of the pairs of guide-rods 5, 6 with the coupling 9 and transverse bars 13, 14, represents an inherently rigid structure.

In the region of the free ends 2*b* of the starting head 2, the coupling 9 supporting the release surfaces 10 comprises stop dogs 9*a*, which extend into the path of movement of the starting head 2. The path of movement of the starting head 2 with its open-link chain as well as that of the hot section 1 is determined by the guide-rollers 16, 17 of the guide means for the section as well as the roller bed rollers 18, 19 of the delivery roller bed. At least the last upper guide roller 17 is mounted in a rigid manner and protects the hot section 1 from deflection in an upwards direction during the detaching operation. The guide rollers 17 are omitted in FIG. 1, for purposes of clarity.

In FIG. 2, the detaching apparatus is located in the initial position, in which the guide rods 5 and 6 are inclined obliquely with respect to the feed direction of the hot section 1. In this initial position, the release surfaces 10 engage below the free ends of the starting head 2 and the stop dogs 9*a* engage partly in the horizontal projection of the free ends 2*b* of the starting head 2. This initial position of the guide-rods 5, 6 forming a parallelogram is determined by a vertical stop 20.

Serving to position the guide-rods 5, 6 forming a parallelogram in the initial inclined position is a pivotally mounted double-acting hydraulic cylinder 21 whose piston rod 21*a* engages one of the guide-rods 6.

A 4/3-way valve with a floating zero position 22 is provided for controlling the hydraulic cylinder 21. In order to position the detaching apparatus in the initial position determined by the stop 20, the valve 22 is set at the switching position A, in which the large piston surface of the cylinder is acted upon by way of the pressure line 23. When the initial position is reached, a follow-up control (not shown) initiates switching of the valve 22 to the floating zero position B, in which the hydraulic cylinder 21 is pressureless, i.e. is under no load conditions.

Figure 3:
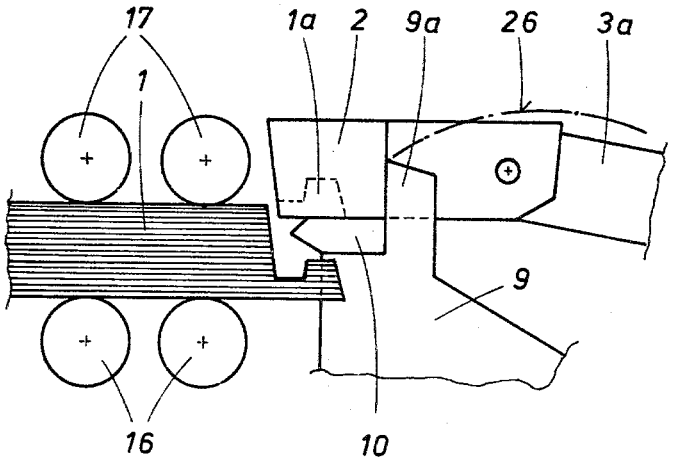
FIG. 3 is an enlarged detail showing the detachment of a key-piece.
Figure 4:
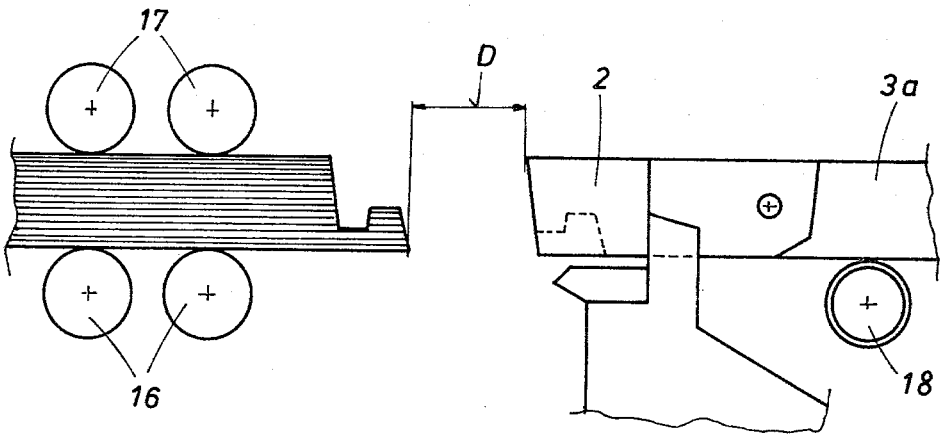
FIG. 4 is a corresponding detail showing subsequent deposition of the key-piece.

The method of operation of the detaching apparatus according to the invention is as follows: If, after starting-up the continuous casting installation, the open-link chain 3 of the cold section firstly passes the detaching apparatus located in the initial position, the stop dogs 9*a* remain unaffected by the open-link chain 3. However, when the free ends 2*b* of the starting head 2 abut against the stop dogs 9*a*, the coupling 9 attempts to move with the latter, which leads to a swinging movement of the guide-rods 5 and 6 forming a parallelogram in clockwise direction. Due to this, the release surfaces 10 exert a detaching force directed at right-angles to the hot section 1 on the starting head 2, which force strives for infinity as the guide-rods 5, 6 approach the vertical position. Since the hot section 1 is protected from deflection by the upper guide rollers 17, the starting head must be detached from the hot section (FIG. 3). At the time of this detaching movement initiated solely by the feed of the hot section 1, the hydraulic cylinder 21 is inactive, since its control valve 22 is set at the central floating zero position B. When the guide-rods 5, 6 are in the vertical position, at the latest, the valve 22 is moved to the switching position C by a control which is likewise not shown, due to which the line 24 becomes the pressure line and pressure oil acts on the small piston surface of the cylinder 21. Since the feed pump (not shown) delivers a constant quantity, the withdrawal of the piston rod 21*a* takes place in an accelerated manner. Since the coupling 9 describes an arc 26 owing to the positive guidance of the guide-rods, in conjunction with the accelerated return movement of the guide-rods 5, 6, the starting head 2 is detached completely from the hook-like cast connection to the hot section 1 and finally deposited on the delivery roller bed with the roller bed rollers 18, 19 at a distance D in front of the hot section (FIG. 4). The adjusting movement of the guide-rods 5, 6 forming a parallelogram extends as far as the final position shown in dot-dash lines in FIG. 2, in which the coupling 9 is in positon 9′ and the stop dogs 9*a* are located in the position 9*a*′ below the plane of the roller bed. In this end position, which is also illustrated in FIG. 1 for the parts 9′, 9*a*′ and 10′, the cold section 2, 3 can be discharged unhindered, until it is lifted up by a crane.

I claim:

1. Continuous casting apparatus, comprising:

opposing sets of rollers defining a guide path for a cast section emanating from a mould outlet;

a key-piece engageable with the leading end of the cast section, and arranged to be movable with said cast section when engaged therewith along said guide path in a direction away from said mould outlet; and a key-piece detaching mechanism located at the end of said guide path, said mechanism including a detachment member mounted for entrainment by said key-piece as said key-piece moves along said guide path when engaged with said cast section, and said mechanism including means arranged to mechanically generate a force in response to said movement of said engaged cast section and key-piece, said means being further arranged so that said generated force is directed transversely of the cast section feed direction and acts upon said key-piece through said detachment member for detaching the key-piece from the cast section.

2. Apparatus as claimed in claim 1, wherein an open-link chain conveyor is attached to the key-piece and the key-piece has end portions extending laterally beyond said chain conveyor.

3. Apparatus as claimed in claim 2, wherein the detachment member has abutment surfaces arranged in the paths of travel of said end portions for entrainment thereby.

4. Apparatus as claimed in any one of claims 1 to 3, wherein the guide path is horizontal and the detachment member is mounted for movement in a forward and upward direction whereby the key-piece is detached from the following cast section.

5. Apparatus as claimed in claim 4, wherein the detachment member is supported by spaced parallelogram linkages for travel along an arcuate path of movement.

6. Apparatus as claimed in claim 4, additionally comprising a double-acting fluid pressure operated piston and cylinder drive for the detachment member, said drive including a control valve having a neutral position in which the piston is unloaded by fluid pressure and is movable in the cylinder by the movement of said engaged cast section and key-piece after said key-piece has entrained said detachment member.

7. Apparatus as claimed in claim 6, wherein the piston has a relatively large surface arranged to be pressurised for moving the detachment member back into its starting position and a relatively small surface arranged to be pressurised for completing movement of the detachment member in the opposite direction.

8. Apparatus as claimed in claim 1, wherein the detachment member has at least two release surfaces for contacting the key-piece during detachment thereof.

9. Apparatus as claimed in claim 8, wherein the detachment member is an elongate element with three raised portions providing the release surfaces.

10. Apparatus as claimed in claim 1, wherein the detachment mechanism is located in a gap between the end of the guide path defined by the opposing sets of rollers, and a delivery roller bed.

11. Continuous casting apparatus, comprising:

opposing sets of rollers defining a guide path for a cast section emanating from a mould outlet;

a key-piece engageable with the leading end of the cast section, and arranged to be movable with said cast section when engaged therewith along said guide path in a direction away from said mould outlet; and a key-piece detaching mechanism located at the end of said guide path, said mechanism including a detachment member mounted for entrainment by said key-piece as said key-piece moves along said guide path when engaged with said cast section, and a pair of spaced parallelogram linkages supporting said detachment member for travel along an arcuate path of movement, said mechanism being arranged to mechanically generate a force in response to said movement of said engaged cast section and key-piece, the generated force being directed transversely of the cast section feed direction by said parallelogram linkages to act upon said key-piece through said detachment member for detaching the key-piece from the cast section.

* * * * *